US005662519A

United States Patent [19]

Arnold

[11] Patent Number: 5,662,519

[45] Date of Patent: Sep. 2, 1997

[54] CONTOUR SANDER

[76] Inventor: Robert A. Arnold, 1900 High Dr., Liberty, Mo. 64068

[21] Appl. No.: 731,396

[22] Filed: Oct. 18, 1996

[51] Int. Cl.[6] ..... B24D 15/00

[52] U.S. Cl. ..... 451/525; 451/523; 451/524; 451/495; 451/913

[58] Field of Search ..... 451/495, 523, 451/524, 525, 526, 527, 530, 538, 539, 913

[56] References Cited

U.S. PATENT DOCUMENTS

| | | | |
|---|---|---|---|
| 1,067,280 | 7/1913 | Smilovetz | 451/524 |
| 1,927,574 | 9/1933 | Parks | 451/524 |
| 2,112,593 | 3/1938 | Campbell | 451/524 |
| 2,954,649 | 10/1960 | Carroll et al. | 451/525 |
| 3,540,160 | 11/1970 | Rose et al. | 451/523 |
| 3,676,888 | 7/1972 | Akers | 15/245 |
| 4,137,670 | 2/1979 | Goralski | 451/524 |
| 4,930,267 | 6/1990 | Hill et al. | 451/525 |
| 5,054,248 | 10/1991 | Thayer | 451/524 |
| 5,131,193 | 7/1992 | Demers | 451/523 |
| 5,203,123 | 4/1993 | Travis | 451/523 |

*Primary Examiner*—James G. Smith
*Assistant Examiner*—Dona C. Edwards
*Attorney, Agent, or Firm*—Hovey, Williams, Timmons & Collins

[57] ABSTRACT

A contour sander for sanding a curved surface includes a hard backing plate having a support face for supporting a sheet of sandpaper. The backing plate is uniformly flexible along substantially its entire length for conforming generally to the curvature of the surface. A pliable handle extends along the length of the plate and follows flexure of the plate when a sanding pressure is applied against the handle.

41 Claims, 3 Drawing Sheets

CONTOUR SANDER

BACKGROUND OF THE INVENTION

1. Field of the Invention

The present invention relates generally to a sander for smoothening out the ripples and undulations defined along a curved surface. More particularly, the invention concerns a contour sander having sufficient flexibility to conform to the curvature of the surface when a sanding pressure is applied, yet also sufficient hardness to be unimpressionable by the surface ripples and undulations.

2. Discussion of the Prior Art

In various industries, it is often necessary to smoothen a curved surface. For example, the automotive after-market repair industry is continuously involved with the repair of curved body panels. As those of ordinary skill in the art will appreciate, sanding precision and the surface smoothness directly affect the appearance of the repaired panel. That is, surface roughness and deviations from the original shape of the panel are readily visible when a coat of glossy paint is applied to the panel. Of course, such imperfections drastically reduce the aesthetics and resale value of the vehicle. It will be appreciated that repair of curved body panels has recently become especially prevalent as vehicle bodies have become more aerodynamic.

Assuming the damaged body panel is repairable, the repair process typically begins with reshaping the damaged area of the panel back to its basic original configuration with a hammer or pry. The reshaped area of the panel is subsequently covered with a suitable body filler, such as a polyester based putty, for filling depressions in the surface (i.e., the places where the body mechanic was unable to reform the panel back to its original shape). The filler is usually manually smeared onto the reshaped surface of the panel, and consequently, the top surface of the filler presents an undulating or rippled surface. That is, the mechanic is unable to apply a perfectly smooth layer of body filler. Accordingly, the damaged area must be sanded prior to painting. In most cases, smoothening of the area not only involves sanding out the undulations of the body filler but also applying and sanding a suitable primer, such as a lacquer or urethane based primer. Finally, the repaired area may be coated with a desired paint.

The sanding steps of the repair process may be performed a number of ways. If desired, the mechanic may simply grasp a sheet of sandpaper with his or her hands and apply a sanding pressure directly against the back face of the sheet. However, this approach often results in an unevenly sanded surface and is extremely time consuming and tiresome. It is also difficult to maintain the grasp on the sandpaper. Although devices have been developed to facilitate the sanding steps, conventional sanders are problematic, as illustrated in FIGS. 8–10 and described hereinbelow.

FIG. 8 shows a conventional "finish sander", generally designated by the numeral 200, having a foam rubber block 202 and a rubber release pad 204. A sheet of sandpaper (not shown) having a pressure-sensitive adhesive undercoating is releasably attached to the release pad. The finish sander 200 is a relatively soft, "sponge-like" item which can be compressed in virtually any direction, although the pad 204 is more dense and resistant to compression than the foam rubber block 202. Accordingly, when a sanding pressure is applied on the block 202, the sander 200 has the ability to conform generally to the surface curvature of the body filler F, as shown in FIG. 8 (i.e., the upper and lower faces of the sander 200 are normally parallel and substantially flat).

However, because of the softness of the sander 200, a bump B projecting from the filler surface indents the bottom of the sander. In other words, the sander 200 is impressionable by undulations defined along the surface of the filler F.

The impressionability of the finish sander 200 poses several problems. For example, because the finish sander 200 follows the undulations of the filler surface, both the ridges and valleys of the surface (the so-called "highs" and "lows") are sanded. As those of ordinary skill in the art will appreciate, the highs must be sanded down before any material is removed from the lows; otherwise, the surface may never be smoothened. In fact, the highs may only become more pronounced if the lows are sanded. Moreover, sanding of the lows will eventually gouge into the surface of the body panel, or create depressions below the original shape of the panel, such that the body filler must be reapplied.

Furthermore, the compressibility of the finish sander 200 makes it very difficult for the user to evenly distribute and control the sanding pressure. The finish sander also fails to provide a comfortable gripping portion for minimizing hand fatigue and slippage from the user's grasp.

FIGS. 9–10 illustrate another prior art sanding device, generally designated by the numeral 300, known as a "file-board sander". The file-board sander 300 includes a base plate 302, a handle 304 and a knob 306. A pair of clips 308 and 310 at either end of the base plate 302 serve to secure a sheet of sandpaper to the base plate. Extending along the top face of the base plate 302 are a plurality of laterally spaced, longitudinal strengthening ribs 312, which serve to rigidify the base plate along its length. As those of ordinary skill in the art will appreciate, the sander 300 is specifically constructed for movement in a longitudinal direction; the sander 300 may roll over if it is moved laterally (i.e., side-to-side). In operation, the user grips the handle 304 with one hand and the knob 306 with the other, applies sanding pressure toward the surface, and moves the sander 300 in a longitudinal direction.

Contrary to the finish sander discussed above, file-board sanders have hard base plates that bridge the lows and contact only the highs of the body filler F (see FIG. 10). However, the base plates of most file-board sanders have virtually no flexibility along the length thereof. Consequently, the base plate cannot conform to the curvature of the surface. Further, only a small portion of the rigid base plate is able to contact the curved surface, and accordingly, the sanding process becomes very time consuming. Moreover, sanding with a rigid base plate tends to create flat areas along the surface such that the repaired panel becomes a plurality of highly visible, small flats rather than a continuous curve.

The file-board sander 300 shown in FIGS. 9–10 is somewhat exceptional in that the base plate 302 is flexible along a portion of its length, even though the strengthening ribs 312 have been provided to prevent such flexure. Although the handle 304 and knob 306 rigidify the ends of the base plate 302, the flexible portion of the base plate is spaced between the handle and knob, as shown in FIG. 9. This portion conforms generally to the curvature of the body panel P and is unimpressionable by the undulations of the body filler F.

Although the automobile after-market repair body industry has used the sander 300 because of its slight flexibility, this type of file-board sander is problematic. For example, a significant force must be exerted against the sander 300 to flex the base plate 302, which becomes tiresome and tends to result in gouging of the body filler F. Extreme sanding pressures have also been known to clog and tear the sheets of sandpaper. These problems are magnified because the sanding pressure applied against the sander 300 is localized to the small area of the base plate 302 contacting the surface. Furthermore, the sander 300 tends to rock from end-to-end during the sanding process.

OBJECTS AND SUMMARY OF THE INVENTION

Responsive to these and other problems associated with conventional sanders, an important object of the present invention is to provide a sanding device which is specifically designed for sanding curved surfaces. Another object of the present invention is to provide a contour sander which is particularly useful in sanding the curved body panels of an automobile. Additionally, an object of the present invention is to provide an inexpensive yet durable sander that maximizes contact between the sheet of sandpaper and the curved surface so as to reduce the time necessary to sand a given surface area. A further object of the present invention is to provide a sander which may be moved in virtually any direction to sand a curved surface. Another object of the present invention is to provide a sander which evenly applies the sanding pressure against the curved surface. Yet another object of the present invention is to provide a contour sander with a backing plate for supporting a sheet of sandpaper, wherein the backing plate has uniform flexibility along substantially the entire length thereof for conforming to the curvature of the surface, yet is unimpressionable by the undulations defined along the surface. In this respect, another object of the present invention is to provide a handle which does not limit the flexibility of the backing plate.

In accordance with these and other objects evident from the following description of a preferred embodiment of the invention, the contour sander includes a hard backing plate that is uniformly flexible along substantially its entire length for conforming generally to the curvature of the surface. A pliable handle extending along the length of the plate is so configured and constructed as to not limit the flexibility of the hard backing plate. Accordingly, the backing plate bridges the lows yet generally follows the curvature of the surface so that the ends of the sander are not disengaged from the surface.

The preferred backing plate has a generally rectangular shape with a sandpaper support face and a spaced attachment face defining a uniform plate thickness therebetween. The attachment and support faces are generally flat. If desired, the backing plate may be formed of a polycarbonate material having a Rockwell hardness number from about M70 to M78.

The handle and backing plate are preferably coextensive so that the user can grip the sander and apply sanding pressure wherever necessary to flex the backing plate. The preferred handle has a substantially flat attachment face which is adhered by suitable means to the attachment face of the backing plate. The preferred handle also has a uniform cross-section along substantially the entire length thereof. Additionally, the handle has a spaced pair of side gripping faces, each having a generally concavo-convex shape to present a recess running along the length of each side. This shape has been found to be comfortable and to reduce hand fatigue. If desired, the handle is formed of an extruded closed cell foam rubber.

BRIEF DESCRIPTION OF THE DRAWING FIGURES

A preferred embodiment of the invention is described in detail below with reference to the attached drawing figures, wherein.

DETAILED DESCRIPTION OF THE PREFERRED EMBODIMENTS

Figures 1, 2, 3, 4:
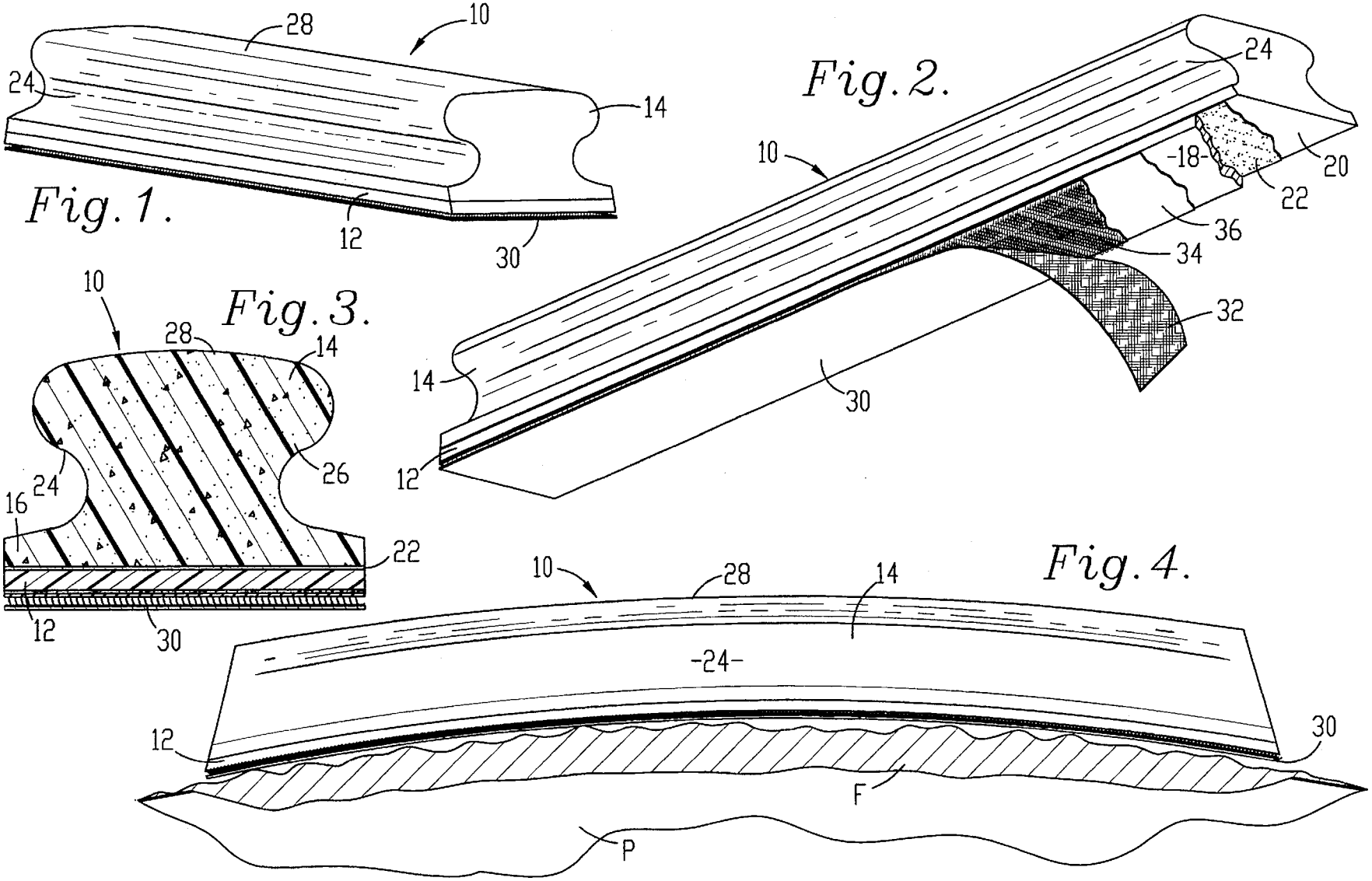
FIG. 1 is a perspective view of a contour sander constructed in accordance with the principles of the present invention.
FIG. 2 is an enlarged perspective view of the bottom of the sander depicted in FIG. 1, with parts being broken away to illustrate the details of construction of the sander.
FIG. 3 is an enlarged vertical cross-sectional view of the sander illustrated in FIG. 1, particularly illustrating the configuration of the handle.
FIG. 4 is an enlarged side elevational view of the contour sander in operation, particularly illustrating the sander generally conforming to the curvature of the surface, yet the backing plate being unimpressionable by the undulations defined along the surface.

The contour sander 10 selected for illustration generally includes a hard backing plate 12, which is uniformly flexible along substantially its entire length, and a pliable handle 14 attached to the upper face of the plate 12. In the illustrated application, the sander 10 is used to smoothen out the undulations of a body filler F applied to a curved automobile body panel P (see FIG. 4). Note, the undulating profile of the filler F presents highs and lows. As will subsequently be described, the backing plate 12 is constructed to conform generally to the curvature of the panel P, when a sanding pressure is applied on the handle 14, without being impressed by the undulations defined along the filler surface so that the plate rides along the highs of the filler. Further, the handle 14 is configured to transfer the sanding pressure to the backing plate 12 without limiting the flexibility of the plate.

The backing plate 12 is generally rectangular and presents substantially parallel, flat upper and lower faces 16 and 18, respectively. As perhaps best shown in FIGS. 3 and 4, the plate 12 consequently has a uniform thickness. The fact that the cross-section of the plate 12 does not vary from end to end lends to the uniform flexibility of the plate along substantially its entire length. In other words, it is not necessary that the upper and lower faces 16 and 18 be flat and substantially parallel, as long as the plate has a substantially uniform cross-section from end to end.

As indicated above, the backing plate 12 must be formed of a material which has sufficient flexibility to conform to the curvature of the body panel P when a sanding pressure is applied to the handle 14. Of course, the flexibility of the backing plate 12 is dependent upon, among other things, its thickness and cross-sectional configuration. Additionally, the backing plate must be unimpressionable by the undulations of the body filler F when a sanding pressure is applied on the handle 14. As indicated above, it is important that the backing plate be unimpressionable so that the sanding occurs only at the highs defined along the body filler surface. The term unimpressionable, as used herein, shall be interpreted to mean that the backing plate 12 does not conform to the undulations (i.e., highs and lows) of the surface when a sanding pressure is exerted against the handle 14. In other words, an unimpressionable surface cannot be depressed by the undulations defined along the surface. Accordingly, the backing plate 12 must have sufficient surface hardness to resist compression caused by the undulations of the body filler F. However, it is impossible to quantify a critical surface hardness number that is applicable to various materials since each material behaves in a different manner. Particularly, there is no known method for relating a surface hardness number, such as a Rockwell hardness number, to various types of materials. It has been determined that the impressionability of the material may be quickly ascertained simply by pressing against the surface with the thumbnail. If the thumbnail readily depresses the surface, then the material is too soft. On the other hand, if the thumbnail only creates a thin shallow indentation, scratches the surface, or has no effect on the surface whatsoever, then the material is most likely unimpressionable.

Polycarbonate plastic has been determined to be a suitable material which exhibits the critical characteristics of flexibility and unimpressionability. Polycarbonate plastic has also proven to have outstanding memory such that the backing plate returns to its original flat configuration after conforming to the curvature of the surface. Such material is available from AtoHaas North America, Inc. of Bristol, Pa. TUFFAK A Polycarbonate Sheet. TUFFAK A Polycarbonate Sheet has a flexure modulus of 340,000 pounds per square inch ("psi"), a tensile yield strength of 8,400 psi, and a Rockwell hardness number from about M70 to M78. The illustrated backing plate 12 is cut from a 3/16 inch thick polycarbonate sheet and has a length of approximately sixteen inches and a width of approximately two and three-fourths inches. However, the backing plate 12 may be formed of other suitable materials including fiberglass, various other plastics, aluminum, spring steel, etc.

Turning to the handle 14, the backing plate 12 and handle are coextensive. In other words, the handle 14 extends the entire length and width of the backing plate 12 to substantially cover the plate. In the illustrated embodiment, the handle 14 includes a substantially flat lower face 20 adhered to the upper face 16 of the baking plate by suitable means, such as a layer 22 of contact adhesive (see FIGS. 2 and 3). The gripping portion of the handle 14 projects upwardly from the lower face 20 and presents a pair of side gripping faces 24 and 26. The gripping faces have a concavo-convex shape to present a recess in which the user places his or her fingers, with the palm of the hand being placed on the top face 28 of the handle. The ends of the handle 14 taper inwardly as the top face 28 is approached, and the outermost portions of the side faces 24 and 26 are spaced inwardly from the sides of the backing plate 12, so that the user can keep the sander within the area to be smoothened.

As indicated above, the handle 14 must be so configured and constructed so as to not limit the flexibility of the backing plate 12. The illustrated handle is sufficiently pliable to simply follow the flexure of the backing plate 12, even though it is extends along the entire length and width of the plate. The handle 14 must also be able to transfer the sanding pressure to the backing plate without entirely collapsing (i.e., the handle must retain its basic shape under pressure). It has been determined that one type of material suitable for this purpose is an extruded closed cell foam rubber. The preferred material is available from Rubatex Corporation of Roanoke, Va. as Type 1600. Such material has a density of 15–19 pounds per cubic foot, a compression deflection value of 9–13 psi (at 25% compression), and an elongation at rupture of approximately 150%. However, it is entirely within the ambit of the present invention to form the handle of various other materials.

Although the foam rubber handle 14 has some resistance to bending, such resistance is negligible compared to resistance of the backing plate 12. Accordingly, the handle essentially does not interfere or limit the flexibility of the plate.

A sandpaper sheet 30 having generally the same width and length as the as the backing plate 12 is removably supported on the lower face 18 of the plate. Preferably, hook-and-loop fastening means is provided for releasably securing the sandpaper sheet 30 to the support face. As shown in FIG. 2, the fastening means includes a plurality of loops covering the back face 32 of the sandpaper sheet 30 and a hook sheet 34 fixedly adhered to the lower surface 18 of the plate 12 by a suitable adhesive layer 36. It will be appreciated that the hook-and-loop fastening means allows limited longitudinal movement between the sandpaper sheet 30 and the lower face 18, which prevents buckling of the sandpaper sheet 30 when the backing plate 12 is flexed. The hook-and-loop fastening means also has the same "relief" effect as a conventional release pad (designated by the numeral 204 in FIG. 2) which carries an adhesively backed sandpaper sheet. As those of ordinary skill in the art will appreciate, the conventional release pad is formed of a rubber material and allows the sandpaper sheet to deflect slightly during the sanding process for preventing clogging of the sandpaper.

Once the desired sandpaper sheet is attached to the lower face of the backing plate 12, the sander 10 is placed on the surface of the body filler F and a sanding pressure is applied against the handle 14. Because the handle 14 extends along the entire length of the sander, the user's hands may be placed wherever necessary to ensure that the entire lower face 18 of the backing plate 12 is positioned to contact the surface. As shown in FIG. 4, the backing plate 12 consequently conforms to the curvature of the surface while the pliable handle 14 generally follows the flexure of the plate.

As should be apparent, the present invention provides several advantages over the prior art. For example, the sander 10 conforms to the curvature of the surface, rather than the undulations defined therealong (see FIG. 4). Additionally, because the entire lower surface 18 of the backing plate 12 is able to contact the surface, the sanding pressure is distributed evenly across the surface. In this respect, the pressure is exerted against a relatively large area so as to reduce the time required to smoothen the surface. Another advantage is the design of the handle 14 which has proven to be very comfortable yet effective in transferring the sanding pressure to the backing plate 12. Furthermore, the sander 10 does not have a tendency to roll when moved laterally, and accordingly, the sander may be moved in virtually any direction.

Figures 5, 8, 9, 10:
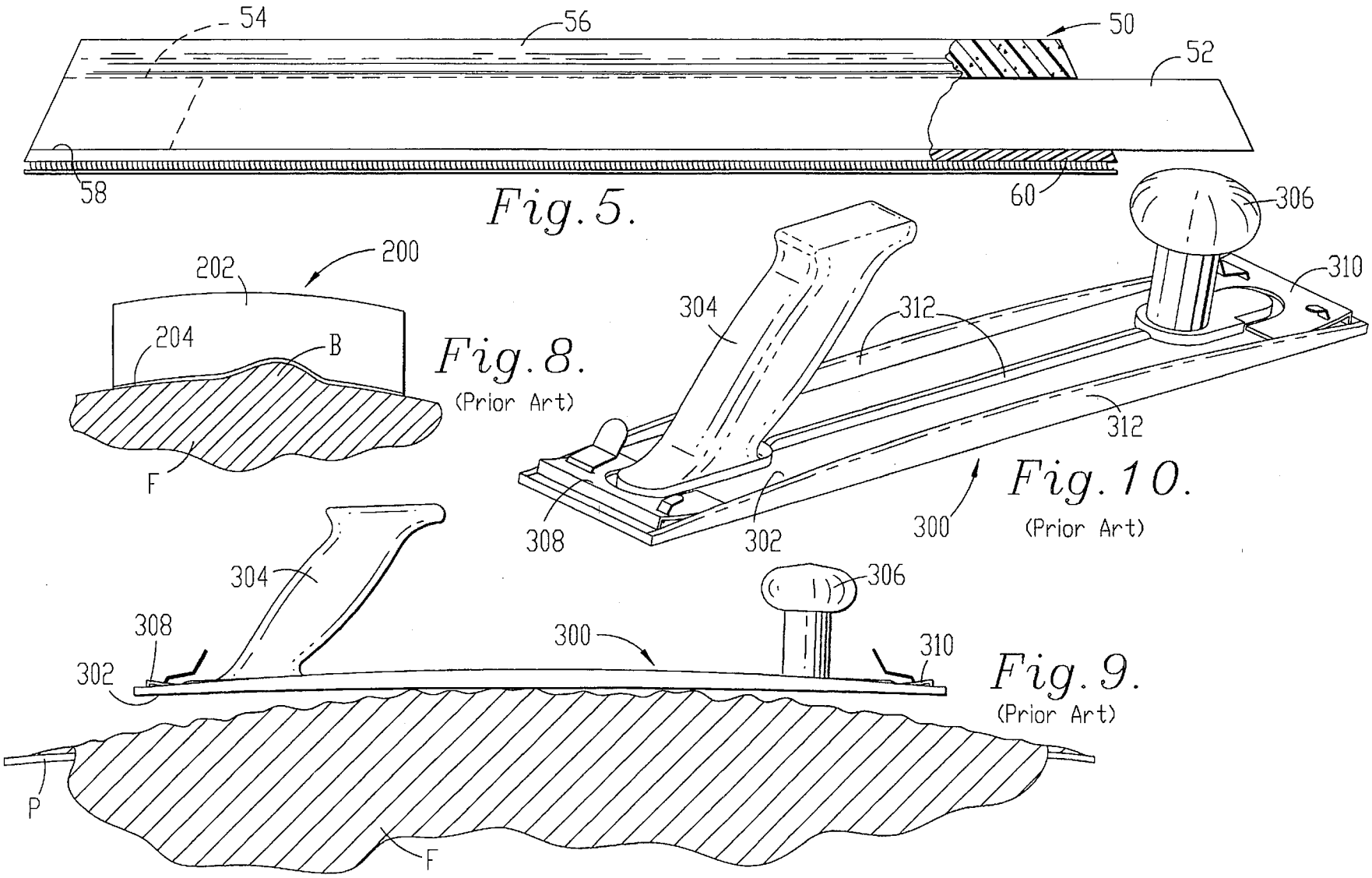
Fig. 8. (Prior Art)
Fig. 9. (Prior Art)
Fig. 10. (Prior Art)
FIG. 5 is a side elevational view of an alternative embodiment of the present invention, particularly illustrating a contour sander having a stiffening bar removably received within a longitudinal slot defined in the handle so as to selectively prevent flexure of the backing plate.
FIG. 8 is a side elevational view of a conventional finish sander, particularly illustrating the bottom of the finish sander being impressed by a bump defined along the surface.
FIG. 9 is a side elevational view of a conventional file-board sander, particularly illustrating the slight flexibility of the sander between the handle and knob and the unimpressionable nature of the base plate.
FIG. 10 is a perspective view of the conventional file-board sander shown in FIG. 9.

Turning to FIG. 5, an alternative embodiment of the present invention is shown comprising sander 50 having a stiffening bar 52 which is removably inserted into a slot 54 defined within the handle 54. The slot 56 preferably extends upwardly from the upper face 58 of the backing plate 60 so that the bar 52 engages the plate. When the stiffening bar 52 is inserted into the slot 54, the backing plate 60 is prevented from flexing, and the sander 50 functions similar to the file-board sander illustrated in FIGS. 9–10. Conversely, when the bar 52 is removed, the backing plate 60 follows the contour of the surface similar to the previously described embodiment.

Figure 6:
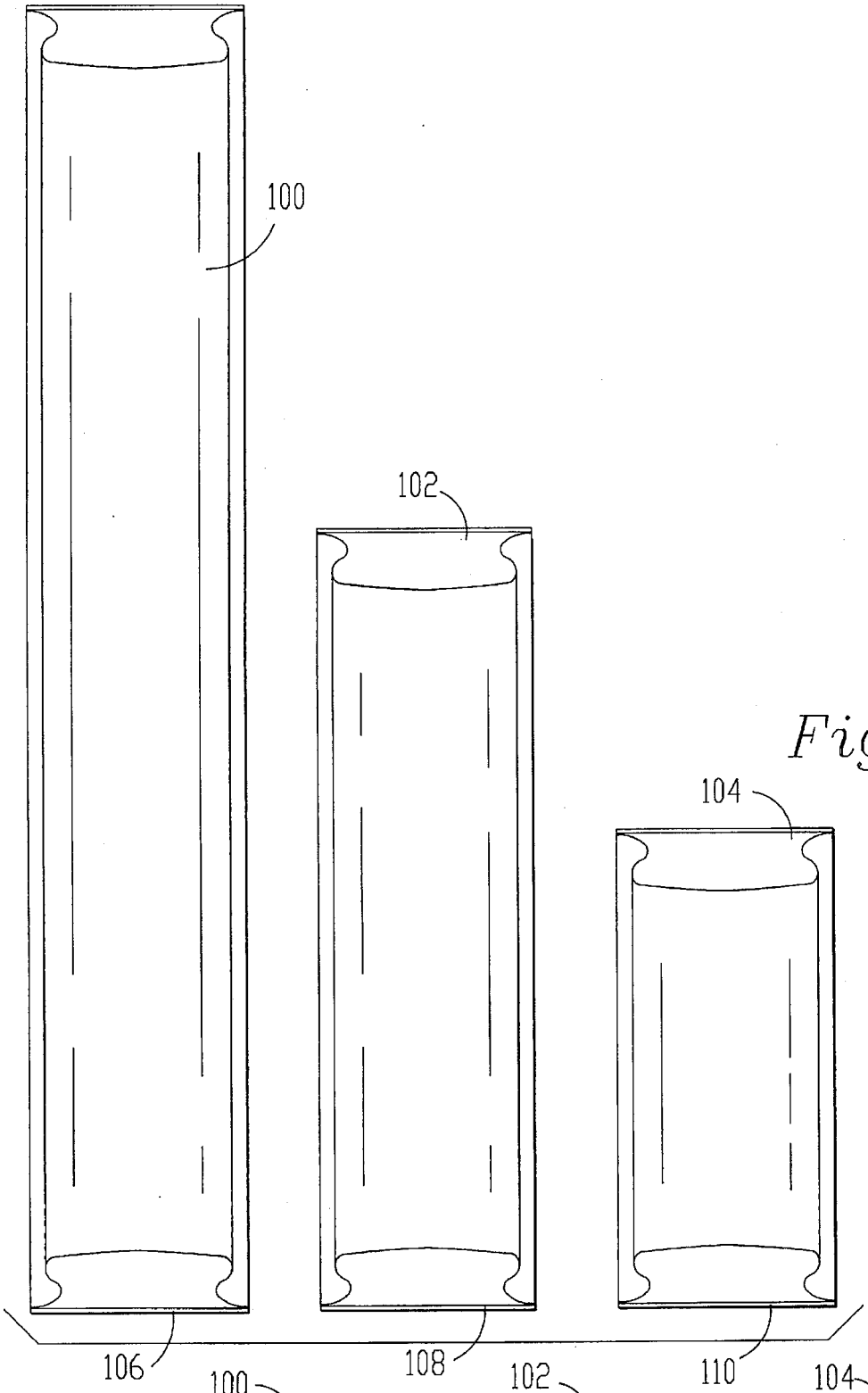
FIG. 6 is a top plan view of a set of contour sanders constructed in accordance with the principles of the present invention, wherein each sander has a different length.
Figure 7:
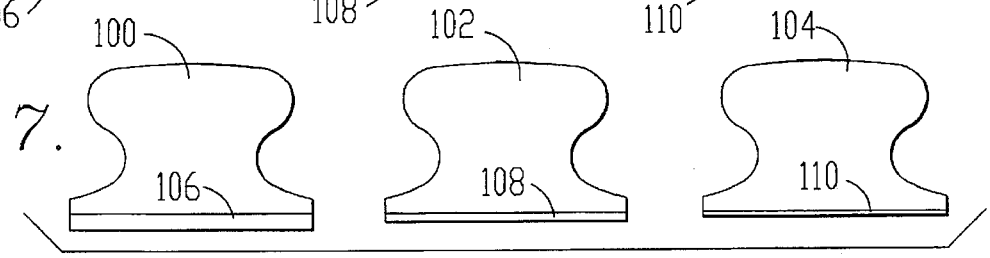
FIG. 7 is an end view of the set of sanders illustrated in FIG. 6, particularly illustrating the various backing plate thicknesses of each plate.

FIGS. 6 and 7 show a set of sanders constructed in accordance with the principles of the present invention. The sanders, generally designated by the numerals 100, 102 and 104, vary in length so that each sander is more suitable than the others for sanding variously sized surface areas. That is, the longest sander 100 is selected when a relatively large area of body filler must be smoothened, while the shortest sander 104 is suitable for a much smaller area. As shown in FIG. 7, each sander 100, 102 and 104 includes a backing plate 106, 108 and 110, respectively, having a different thickness than the other sanders. Specifically, the backing plate thickness increases from the shortest sander 104 to the longest sander 100.

However, the sanders 100, 102 and 104 may be provided with backing plates having the same thickness so that the shorter sanders are relatively more rigid than the longer sanders. Similarly, the backing plate 12 of the sander 10 shown in FIGS. 1–4 may be thickened or narrowed for varying the flexibility of the sander.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention. For example, the sander may be provided with a plurality of handles spaced along the length of the backing plate. Furthermore, the principles of the present invention are equally suitable for various other sanding applications.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A contour sander for sanding a curved surface, said sander comprising:

a hard backing plate having an elongated support face for supporting a sheet of sandpaper; and an elongated handle upon which a sanding pressure may be exerted, said handle being operatively attached to said plate and disposed to transfer sanding pressure to the plate, said plate being uniformly flexible along substantially the entire length of the support face for conforming generally to the curvature of the surface when the sanding pressure is applied, said plate having sufficient memory to return to its original configuration when said sanding pressure is relieved, said handle being so configured and constructed as to not limit the flexibility of the plate, said handle being axially stretchable to accommodate flexure of said plate when said sanding pressure is exerted.

2. A contour sander as claimed in claim 1, said plate having an elongated attachment face spaced from the support face, with the faces defining a uniform plate thickness therebetween.

3. A contour sander as claimed in claim 2, said faces being substantially flat.

4. A contour sander as claimed in claim 3, said plate having a generally rectangular shape.

5. A contour sander as claimed in claim 4, said plate being formed of a plastic material.

6. A contour sander as claimed in claim 5, said plate having a Rockwell hardness number from about M70 to M78.

7. A contour sander as claimed in claim 4, said handle projecting from the attachment face along substantially the entire length thereof.

8. A contour sander as claimed in claim 7, said handle having a uniform cross-section along substantially the entire length thereof.

9. A contour sander as claimed in claim 8, said handle having a spaced pair of side gripping faces, each having a generally concavo-convex shape to present a recess running along the length of each side.

10. A contour sander as claimed in claim 9, said handle having a substantially flat attachment face, said attachment faces being adhered to one another.

11. A contour sander as claimed in claim 10, said handle being formed of an extruded closed cell foam rubber.

12. A contour sander as claimed in claim 11, said handle having a slot extending the length thereof; and an elongated stiffening element removably received within the slot for selectively preventing flexion of the plate.

13. A contour sander as claimed in claim 12, said slot extending upwardly from the attachment face of the handle so that the stiffening element engages the attachment face of the plate.

14. A contour sander as claimed in claim 12; and a sheet of sandpaper removably supported on the support face.

15. A contour sander as claimed in claim 14, said sheet of sandpaper having a sanding face and an opposite back face; and hook-and-loop fastening means attached to the support face of the plate and the back face of the sandpaper sheet for removably securing the sheet to the support face.

16. A contour sander as claimed in claim 1, said handle and said plate being substantially coextensive.

17. A contour sander as claimed in claim 16, said handle having a uniform cross section along substantially the entire length thereof.

18. A contour sander as claimed in claim 17, said handle being formed of an extruded closed cell foam rubber.

19. A contour sander as claimed in claim 16, said handle having a slot extending the length thereof, and an elongated stiffening element removably received within the slot for selectively preventing flexion of the plate.

20. A contour sander for smoothening out the undulations defined along a curved surface, said sander comprising:

an elongated backing plate having a support face for supporting a sheet of sandpaper, said plate being uniformly flexible along substantially its entire length for conforming generally to the curvature of the surface; and a pliable handle operatively attached to said backing plate and extending along the length of the plate such that the handle follows the flexure of the plate when a sanding pressure is applied against the handle, said backing plate having sufficient memory to return to its original configuration when said sanding pressure is relieved, said handle being axially stretchable to accommodate said flexure of said plate when said sanding pressure is exerted, said backing plate being unimpressionable by the undulations of the curved surface when the sanding pressure is applied.

21. A contour sander as claimed in claim 20, said plate having an attachment face spaced from the support face, with the faces defining a uniform plate thickness therebetween.

22. A contour sander as claimed in claim 21, said faces being substantially flat.

23. A contour sander as claimed in claim 22, said plate having a generally rectangular shape.

24. A contour sander as claimed in claim 23, said plate being formed of a plastic material.

25. A contour sander as claimed in claim 24, said plate having a Rockwell hardness number from about M70 to M78.

26. A contour sander as claimed in claim 23, said handle extending along substantially the entire length of the plate.

27. A contour sander as claimed in claim 26, said handle having a uniform cross-section along substantially the entire length thereof.

28. A contour sander as claimed in claim 27, said handle having a spaced pair of side gripping faces, each having a generally concavo-convex shape to present a recess running along the length of each side.

29. A contour sander as claimed in claim 28, said handle having a substantially flat attachment face, said attachment faces being adhered to one another.

30. A contour sander as claimed in claim 29, said handle being formed of an extruded closed cell foam rubber.

31. A contour sander as claimed in claim 30, said handle having a slot extending the length thereof; and an elongated stiffening element removably received within the slot for selectively preventing flexion of the plate.

32. A contour sander as claimed in claim 31, said slot extending upwardly from the attachment face of the handle so that the stiffening element engages the attachment face of the plate.

33. A contour sander as claimed in claim 31; and a sheet of sandpaper removably supported on the support face.

34. A contour sander as claimed in claim 33, said sheet of sandpaper having a sanding face and an opposite back face; and hook-and-loop fastening means attached to the support face of the plate and the back face of the sandpaper sheet for removably securing the sheet to the support face.

35. A contour sander as claimed in claim 20, said handle and said plate being substantially coextensive.

36. A contour sander as claimed in claim 35, said handle having a uniform cross section along substantially the entire length thereof.

37. A contour sander as claimed in claim 36, said handle being formed of an extruded closed cell foam rubber.

38. A contour sander as claimed in claim 20, said handle having a slot extending the length thereof; and an elongated stiffening element removably received within the slot for selectively preventing flexion of the plate.

39. A set of alternately selectable contour sanders for sanding curved surfaces, wherein each sander may be selected because of the degree of curvature of the surface or the size of the area to be sanded, said set comprising:

a first sander including a first hard backing plate having an elongated support face for supporting a sheet of sandpaper; and a first handle operatively attached to said first plate upon which a sanding pressure may be exerted, said first plate being uniformly flexible along substantially the entire length of the support face for conforming to the curvature of the surface when the sanding pressure is applied, said first plate having sufficient memory to return to its original configuration when said sanding pressure is relieved, said first handle being so configured and constructed as to not limit the flexibility of the first plate, said first plate having sufficient memory to return to its original configuration when said sanding pressure is relieved; and at least one additional sander including a second hard backing plate having an elongated support face for supporting a sheet of sandpaper; and a second handle operatively attached to said second plate upon which a sanding pressure may be exerted, said second plate being uniformly flexible along substantially the entire length of the support face for conforming to the curvature of the surface when the sanding pressure is applied, said second plate having sufficient memory to return to its original configuration when said sanding pressure is relieved, said second handle being so configured and constructed as to not limit the flexibility of the second plate, said second plate having sufficient memory to return to its original configuration when said sanding pressure is relieved.

40. A set of contour sanders as claimed in claim 39, said first and second backing plates each having an elongated attachment face spaced from the support face, with the faces defining respective plate thicknesses therebetween, the backing plate thickness of the additional sander being relatively less than the backing plate thickness of the first sander.

41. A set of contour sanders as claimed in claim 39, sand handle and said plate of each sander being substantially coextensive.

* * * * *